US006233767B1

(12) United States Patent
Horowitz

(10) Patent No.: US 6,233,767 B1
(45) Date of Patent: May 22, 2001

(54) INFLATABLE SUPPORT PILLOW

(75) Inventor: David Horowitz, Anjou (CA)

(73) Assignee: Priva Inc., Anjou (CA)

( * ) Notice: Subject to any disclaimer, the term of this patent is extended or adjusted under 35 U.S.C. 154(b) by 0 days.

(21) Appl. No.: 09/585,532

(22) Filed: Jun. 2, 2000

(30) Foreign Application Priority Data

Jun. 7, 1999 (CA) ..... 2273750

(51) Int. Cl.[7] ..... A47G 9/00
(52) U.S. Cl. ..... 5/644; 5/655; 5/490
(58) Field of Search ..... 5/655, 636, 644, 5/490, 655.3

(56) References Cited

U.S. PATENT DOCUMENTS

| | | | | |
|---|---|---|---|---|
| 3,911,512 | | 10/1975 | Plate . | |
| 4,161,794 | * | 7/1979 | Darnfors | 5/644 |
| 4,236,264 | | 12/1980 | Britzman | 5/644 |
| 5,092,005 | * | 3/1992 | Byrn | 5/644 |
| 5,154,649 | * | 10/1992 | Pender | 5/655 |
| 5,239,717 | | 8/1993 | Sue | 5/655 |
| 5,261,134 | | 11/1993 | Matthews | 5/655 |
| 5,519,906 | * | 5/1996 | Fanto-Chan | 5/636 |
| 5,551,109 | | 9/1996 | Tingley et al. | 5/655 |
| 5,581,833 | | 12/1996 | Zenoff | 5/655 |
| 5,664,828 | | 9/1997 | Simon | 297/153 |
| 5,678,265 | | 10/1997 | Meyer | 5/654 |
| 5,790,999 | | 8/1998 | Clark | 5/655 |
| 6,038,720 | * | 3/2000 | Matthews et al. | 5/655 |

FOREIGN PATENT DOCUMENTS

| | | | | |
|---|---|---|---|---|
| 283611 | * | 6/1966 | (AU) | 5/644 |
| 9066696 | | 11/1991 | (AU) . | |
| 2379268 | | 2/1977 | (FR) | 5/655 |

* cited by examiner

*Primary Examiner*—Alexander Grosz
(74) *Attorney, Agent, or Firm*—McFadden, Fincham

(57) ABSTRACT

A portable support pillow suitable for use as a nursing pillow is disclosed. The support pillow has a generally crescent shaped configuration, having a central portion and two opposed arms projecting from the center. The support pillow includes an inflatable air chamber and a removable cover. For use as a nursing pillow, the device is inflated to approximately 75% capacity with air, and provides sufficient support from the air pressure within the air chamber.

6 Claims, 2 Drawing Sheets

INFLATABLE SUPPORT PILLOW

FIELD OF INVENTION

This invention relates to portable support pillows for infants, and more particularly, this invention relates to an inflatable support structure which is suitable for use as a nursing pillow and as a support pillow for infants and toddlers.

BACKGROUND ART

In the prior art, various attempts have been made to provide support pillows which have a foam body provided with different types of contours, and which have a cover to protect the foam. One problem with this type of structure is that most covers, for hygienic purposes, are made of fabrics which can be laundered; typically, fabrics for infant use range from cotton to synthetic blends. Generally speaking, such covers are of a porous nature so that any liquid or moist substance coming in contact with the cover can be transmitted through to the foam body.

The prior art also teaches that such cloth covers are removable from the foam body for the purpose of laundering the cover. However, with liquids which penetrate the foam body, or with substances which migrate from the surface of the cloth cover into the foam body, cleaning of the foam is sometimes difficult if not impossible. So, while the cover can be readily cleaned, the foam body may not be so readily cleanable resulting in the fact that such articles can become non-useable (from a hygienic point of view).

The use of foam bodies for infant pillows is disclosed in U.S. Pat. No. 5,261,134, which also has another disadvantage when one tries to provide a contour for the pillow to permit ready use of the product for infants. Normally, foams have a given density so that the density of the foam at e.g., a narrow end is the same as the density as the foam at the thickest part of the body. When compressed due to a given amount of weight, the foam will obviously not be of a constant depth even though the same foam density is employed, due to the varying thickness of the foam for the body. It would be desirable, even when the pillow has varying thicknesses, to have the same degree of compressibility whether at a thin portion of the pillow or at its thickest part.

The present invention solves the above problems of the above type of prior art (such as is disclosed in U.S. Pat. No. 5,261,134) in reducing or eliminating the permeability of the fabric covers over a foam body and at the same time, providing an infant pillow which has a generally constant maximum depressibility for the product irregardless of the varying thicknesses of the product.

Other devices typical of the prior art include U.S. Pat. No. 5,154,649 and U.S. Pat. No. 5,247,429. Prior art reference U.S. Pat. No. 5,154,649 discloses a multiple chambered device, having at least two chambers where one of the two chambers is fully inflated. Multiple chambered devices suffer from the disadvantages of increased size and costs. Such multi-chambered pillows have increased associated costs for additional material, increased volume requirements, and, from a users point of view there is an increased amount of consumer effort and work involved in inflating and using such devices.

Prior art reference U.S. Pat. No. 5,247,429 also discloses such a "U-shaped" detachable pillow multiple chambered device, wherein the lower chamber is to be filled with a liquid. This device includes a removable valve and lower pillow and does not lend itself for use as a support pillow for nursing an infant.

It is therefore one aspect of certain embodiments of the present invention to provide a portable device for providing support for the entire body of an infant.

It is another aspect of certain embodiments of the present invention to provide a device for providing support for an older child as a backrest or cushion.

It is a further aspect of the present invention to provide an inflatable, readily portable device for providing infant/ child support.

The device of the present invention offers numerous advantages over the prior art. The present invention can be reduced by deflation to a have a substantially smaller size then when inflated, when not in use, for example as for storage.

The device according to the present invention has a separate removable cover which advantageously provides for its removal for ease of washing and cleaning.

The device according to the present invention allows for a manually adjustable air pressure. This permits a user to inflate the air chamber to e.g., 75% inflation for use as a nursing pillow. In an alternative embodiment, the air chamber can be fully inflated if desired for older children to use as a back rest or cushion.

A further advantage over the prior art is that the device according to the present invention provides for a constant air pressure and subsequent air support for an infant in the nursing position. In a nursing support use, the air pressure inside the support pillow automatically conforms to the users body contours, and also that of the nursing infant.

SUMMARY OF INVENTION

In accordance with the present invention, a single chambered crescent shaped support pillow is provided, which is adapted to be used for supporting a baby during breast or bottle feeding. Alternatively, the support pillow may be used by older children as a backrest or cushion.

Accordingly, one aspect of the present invention is to provide a support pillow suitable for nursing comprising a one piece monolithic inflatable substantially crescent shaped body and an air valve therefor, the inflatable body having a substantially crescent shaped air chamber, the air chamber having an upper and lower panels including a central portion and connected opposed projecting arms having first and second ends; the air chamber when inflated being adapted to maintain a constant air pressure within the entire body, and where the central portion of the body having a vertical thickness that varies from a maximum thickness along the central portion and along said opposed projecting arms near the central portion, to a minimum thickness at each of the ends of the opposed arms, and the connecting arms projecting in opposite directions from the central portion of the inflatable body, the respective first and second ends of the arms being curved about a vertical axis to define said substantially crescent shaped body and to position the first and second end portions in an opposed relationship to one another, the arms and central portion defining an interior recess by the crescent shaped body, the arms gradually tapering from the central portion to the first and second ends of the arms in an outwardly extending manner, and the opposed arms having respective first and second downwardly and radially inwardly inclined support surfaces along and adjacent the recess; and including a removable flexible exterior cover member having a crescent shaped body adapted to fully enclose the inflatable body, the removable cover member including an upper and lower portion, the removable cover having a centrally located closable opening to permit access to the air valve.

The support pillow cover may preferably be constructed of hypoallergenic materials, and further may be selected from the group including cotton, nylon, polyester, polypropylene or the like.

Preferably, the centrally located closable opening of the removable cover is positioned along the outer curve in an opposed relationship to the recess. Likewise the air valve is centrally located along the outer curve in an opposed relationship to the recess, and most desirably, positioned so as to be accessible to a user when the closable opening is opened.

Further, it is another preferred embodiment of the present invention, that the inflatable air chamber is constructed of a plastic material, such as from polyvinyl chloride.

DETAILED DESCRIPTION OF THE PREFERRED EMBODIMENT

Figure 1:
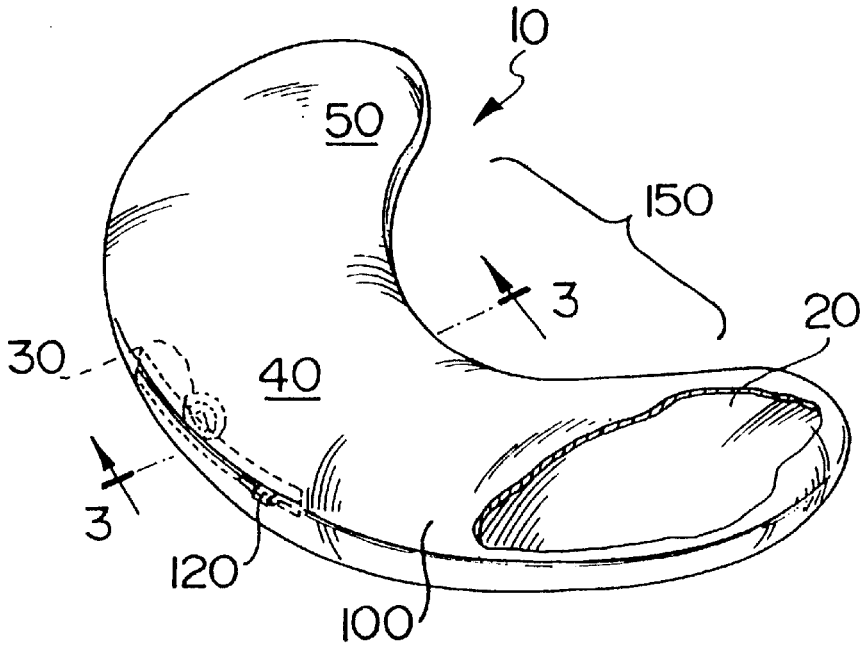
FIG. 1 is a top perspective view of a support pillow in accordance with the present invention with a cut-a-way view of the inner air chamber.

In the preferred embodiment of the present invention, there is provided an inflatable support pillow generally indicated by the reference numeral 10. As illustrated in FIG. 1, the support pillow 10 is shown in an inflated condition. In a preferred use, such as when breast or bottle feeding a baby, the nursing pillow is most desirably inflated to approximately three quarters its capacity.

Inflatable pillow 10 includes a cover 100 which includes a closable opening 120. The inflatable pillow 10 also includes an air chamber 20 with an air valve 30. As illustrated in FIG. 1, the inflatable pillow 10 when in an inflated condition, has a symmetrical, generally crescent shaped outline. The air chamber 20 is of a generally symmetrical configuration from top and bottom and from side to side. As the pillow has a symmetrical shape, either side or surface can therefore be used. The air chamber 20 is preferably manufactured from upper and lower panels.

Figure 2:
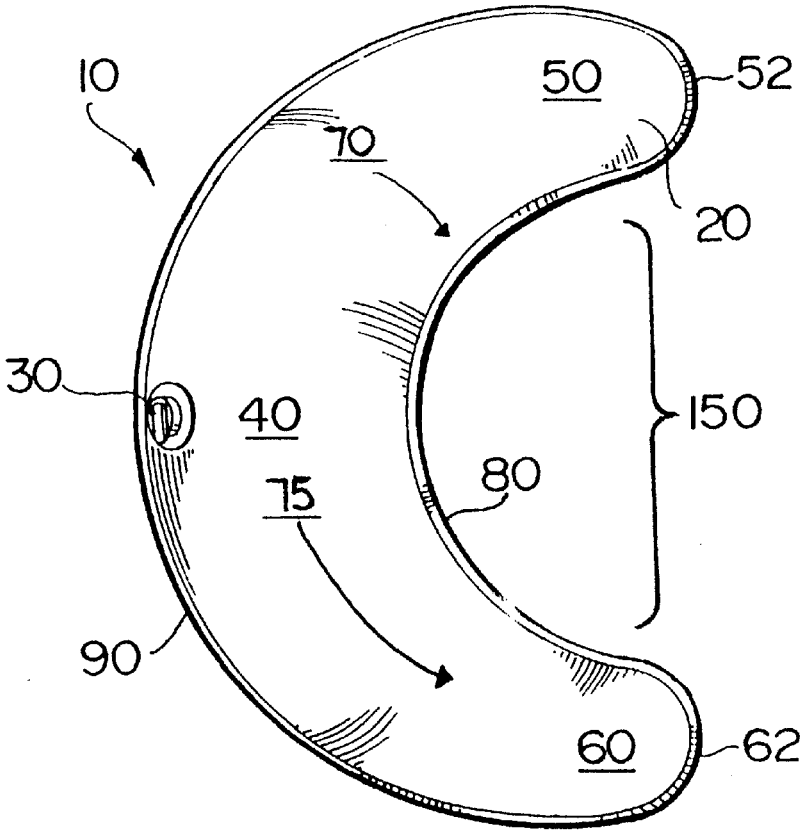
FIG. 2 is a top plan view of the air chamber of the present invention.

As shown in FIG. 2, the crescent shaped air chamber 20 is shaped to provide adjustable support about a users torso. The crescent shape of the support pillow 10 lends itself very well for ambidextrous use by the user. The user may position an infant to be nursed or bottle fed on either side for feeding of an infant.

When viewed from an elevational perspective along a vertical plan, the crescent shaped air chamber 20 has a downwardly curved outer surface and a downwardly curved inner surface defining a continuous structure having a generally toroidal configuration or shape. When viewed from a side perspective along a horizontal plan, the crescent shaped air chamber has continuous inner and outer curves which are designated by reference numerals 80 and 90 respectively.

The structure of the support pillow 10, for reasons of simplicity, can be described as having a central portion 40, and two projecting and opposed arm portions 50 and 60 defining a recess 150 between them. The two projecting opposed arm portions 50 and 60 terminate in ends 52 and 62 respectively. The opposed arms 50 and 60, are shaped so as when not under stress do not touch each other, and provide a recess 150 which is adapted to fit around a users torso.

The general crescent shape of the pillow 10 is proportioned such that from a central vertical cross section, (e.g., in the area of horizontal line 3—3 as illustrated in FIG. 1), the pillow has bilateral symmetry. This central vertical axis is also the central point about which the toroidal or crescent shaped body is formed. As described above, the support pillow 10 has, in a preferred embodiment, an overall elliptical shape throughout the central portion and along the length of each arm.

As shown in FIGS. 1 and 2, the support pillow 10 includes a first directional curvature of the pillow arms; arrow 70 generally indicates an outwardly and downwardly sloping surface of the pillow, beginning from a mid point and extending to about the horizontal midline along the curved axis of the pillow.

As also illustrated in FIG. 2, arrow 75 indicates a second curvature feature of the pillow 10. The arrow 75 generally illustrates the sloping and tapering surface extending from a mid point of the pillow, which is the highest point, which gradually tapers in a downward direction to the tips or end portions of each arm (50 and 60 respectively).

The air chamber 20 is formed from two panels, each being impervious to liquids or other like moist substances, and is preferably constructed from a material such as PVC or rubberized plastic. Other materials known in the art may also be used as suitable materials. The preferred material of the air chamber 20 should be able to be inflated to and sustain a constant air pressure, for example within a range of 5–25 psi.

Figure 3:
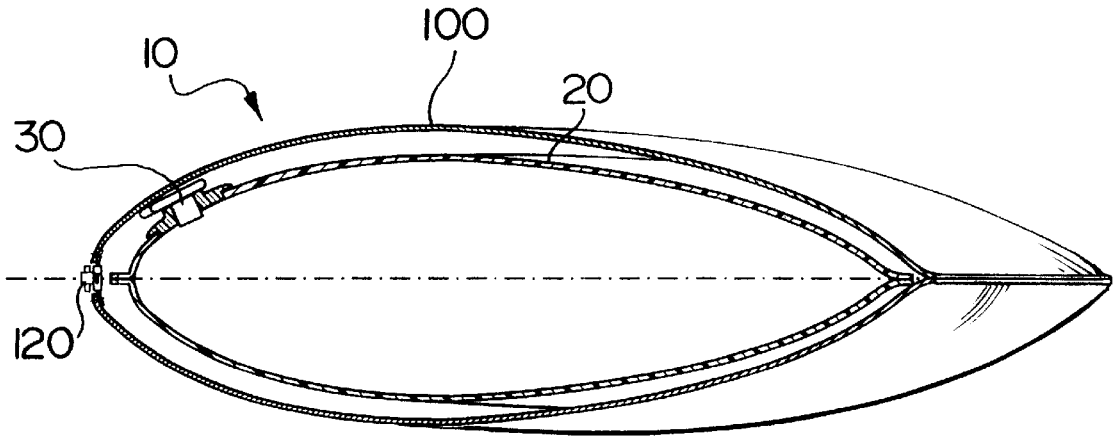
FIG. 3 is a side sectional view taken along the line 3—3 in FIG. 1.

As shown in FIGS. 1 and 3, the air valve 30 is located centrally within the air chamber 20, and is positioned so as to be immediately accessible once the closable opening 120 of the removable cover 100 is opened. The air valve 30 is preferably a standard plastic oral inflator valve, adapted to be manually opened and closed. The air valve 30 is adapted to provide manual adjustment of air pressure within air chamber 20 by a user as needed, through manual inflation or deflation.

Alternatively, other valve means may be provided to inflate the air chamber, such as special valves or air inlets adapted to receive mechanical inflation devices, such as adaptors for air pumps or $CO_2$ cartridges. As described above, the air valve and construction material should be suitable to with-stand an air pressure of 5–25 psi.

The removable cover 100 may be of a any suitable material, although in the preferred embodiment a soft fabric material is used. As illustrated in FIGS. 1 and 3, the removable cover 100 is of sufficient length and width as to completely enclose and envelope the air chamber 20. The removable cover 100 is provided with a closable opening which provides direct access to the air valve 30. The closable opening is adapted to allow the air chamber to be inserted and removed from the removable cover 100 to permit storage or cleaning of the moisture resistant cover 100 and the air chamber 20.

As illustrated in FIGS. 1 and 3, the support pillow 10 has curved crescent shaped configuration to provide a universal support surface which can be used for ambidextrous use of the user. In the configuration shown, the pillow 10 includes a central portion 40 and two opposed projecting arms, 50 and 60 respectively, separated by the central portion.

The support pillow 10 has a substantially continuous contour delineated by continuous inner and outer curves 80 and 90 respectively, thereby defining a generally crescent shape. The arms 50 and 60 extend in opposed directions from the central portion terminating in respective ends 52 and 62.

In use the inflatable support pillow 10 is inflated to approximately 75% volume capacity of the air chamber to provide suitable support for the user and infant. It has been found that the inflation of the air chamber 20 to approximately 75% capacity provides adequate support for the infant when the support pillow is used as an nursing pillow.

The support pillow 10 provides adjustable support for both the user and the infant. When in use as a nursing pillow inflated to approximately 75% capacity of the air chamber 20, the natural contours of a users body are provided for by allowing deformation of the air chamber to the outlines of the user, such as his or her legs and lower torso. When an infant is placed upon the upper surface, the support pillow 10 adapts to the weight and the natural contours of the infant's body and head, by automatically adjusting the air pressure created by the deformations by both the user and infant, thereby providing proper support through constant air pressure and subsequent air support.

In an alternative embodiment, the support pillow 10 may be inflated to approximately 100% capacity of the air chamber 20, thereby allowing older infants or children to use the support pillow as a cushion, back rest or the like.

Although embodiments of the invention have been described above, it is not limited thereto and it will be apparent to those skilled in the art that numerous modifications form part of the present invention insofar as they do not depart from the spirit, nature and scope of the claimed and described invention.

What is claimed is:

1. An inflatable support pillow comprising:

a one piece monolithic inflatable substantially crescent shaped body and an air valve therefor, said inflatable body having a substantially crescent shaped air chamber, said air chamber having an upper and lower panels including a central portion find opposed projecting arms having first and second ends; said air chamber when inflated being adapted to maintain a constant air pressure within said entire body;

said central portion of said body having a vertical thickness that varies from a maximum thickness along the central portion and along said opposed projecting arms near said central portion, to a minimum thickness at each of said ends of said opposed arms, said connecting arms projecting in opposite directions from said central portion of said inflatable body, said respective first and second ends of said arms being curved about a vertical axis to define said substantially crescent shaped body having an inner and outer curve and to position said first and second end portions in an opposed relationship to one another, said arms and central portion defining an interior recess by said crescent shaped body, said arms gradually tapering from said central portion to said first and second ends of said arms in an outwardly extending manner, and said opposed arms having respective first and second downwardly and radially inwardly inclined support surfaces along and adjacent said recess; and a removable flexible exterior cover member having a crescent shaped body adapted to fully enclose said inflatable body, said removable cover member including an upper and lower portion, said removable cover having a centrally located closable opening to permit access to said air valve, said air valve being centrally located along said outer curve, in opposed relationship to said recess, the support pillow being about 25" in length and about 18" in width when in a non-inflated condition.

2. A support pillow according to claim 1, wherein said cover (100) is constructed of a hypoallergenic material.

3. A support pillow according to claim 2, wherein said cover (100) is constructed from a member selected from: cotton, nylon, polyester or polypropylene.

4. A support pillow according to claim 1, wherein said centrally located closable opening (120) is positioned along said outer curve (90) in opposed relationship to said recess (150).

5. A support pillow according to claim 1, wherein said inflatable air chamber (20) is constructed of a plastic material.

6. A support pillow according to claim 5, wherein said inflatable air chamber (20) is constructed from polyvinyl chloride.

* * * * *